United States Patent [19]

Ruschitzka

[11] Patent Number: 4,910,896

[45] Date of Patent: Mar. 27, 1990

[54] IRONING BOARD HAVING FLIP-OUT ATTACHMENTS

[75] Inventor: Friedrich Ruschitzka, Zuzenhausen, Fed. Rep. of Germany

[73] Assignee: Friedrich Ruschitzka Metallwarenfabrik, Zuzenhausen, Fed. Rep. of Germany

[21] Appl. No.: 137,335

[22] Filed: Dec. 13, 1987

[30] Foreign Application Priority Data

Feb. 24, 1987 [DE] Fed. Rep. of Germany ..... 8702793

[51] Int. Cl.[4] ..... D06F 81/02; D06F 81/10; D06F 81/12

[52] U.S. Cl. ..... 38/106; 38/107; 38/111; 38/135; 38/139; 248/188.1

[58] Field of Search ..... 38/104, 106, 107, 135, 38/139, 111; 248/188.7, 188.1

[56] References Cited

U.S. PATENT DOCUMENTS

| | | | |
|---|---|---|---|
| 448,661 | 3/1891 | Miller | 38/107 |
| 889,767 | 6/1908 | Davis | 38/106 |
| 948,479 | 2/1910 | Jennings | 38/107 |
| 1,016,848 | 2/1912 | North | 38/106 |
| 1,027,479 | 5/1912 | Hoffine | 38/106 X |
| 1,073,814 | 9/1913 | Nelson | 38/107 |
| 2,554,446 | 5/1951 | Nestor | 38/107 X |
| 2,554,983 | 5/1951 | Hedges | 38/106 |
| 2,708,323 | 5/1955 | Caddel | 38/111 |
| 2,729,005 | 1/1956 | Foster | 38/139 |
| 2,923,077 | 2/1960 | Tipping | 38/104 |
| 3,698,110 | 10/1972 | Shettel | 38/107 |
| 4,312,086 | 1/1982 | Bianco | 248/188.1 X |

*Primary Examiner*—Andrew M. Falik
*Attorney, Agent, or Firm*—Staas & Halsey

[57] ABSTRACT

An ironing board apparatus includes an ironing board member mounted on a pedestal. The ironing board member has a main portion and a foldaway corner portion pivotally connected to the main portion by a hinge. A retractable sleeveboard is connected to the ironing board member for movement into position with respect to the ironing board. A flat iron tray is retractably mounted to the ironing board, as well as a laundry tray which is pivotally connected to the ironing board member.

17 Claims, 9 Drawing Sheets

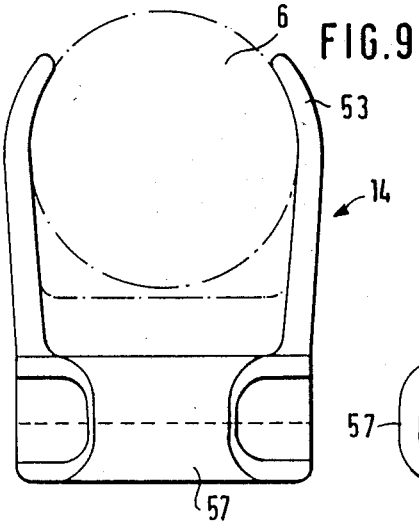
FIG.9
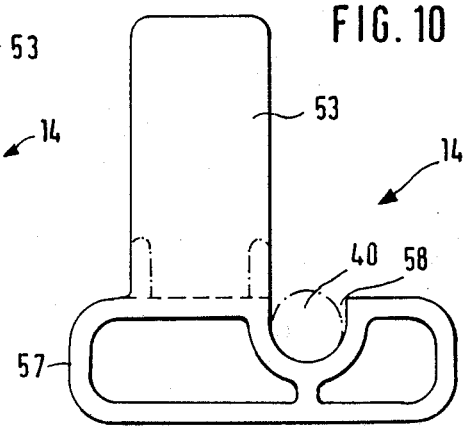
FIG. 10
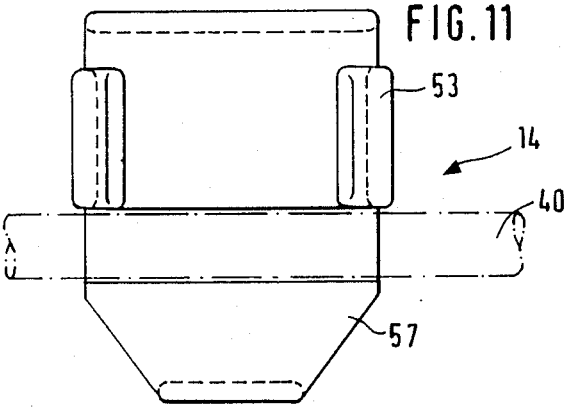
FIG. 11
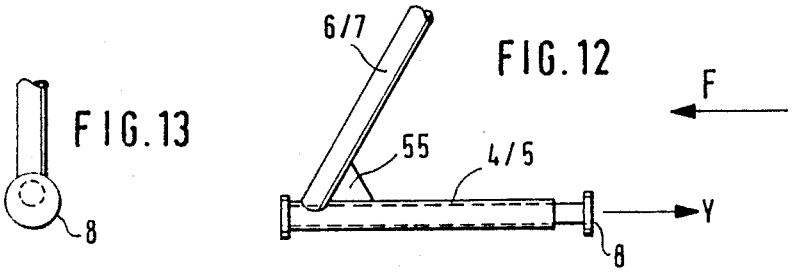
FIG. 12
FIG. 13

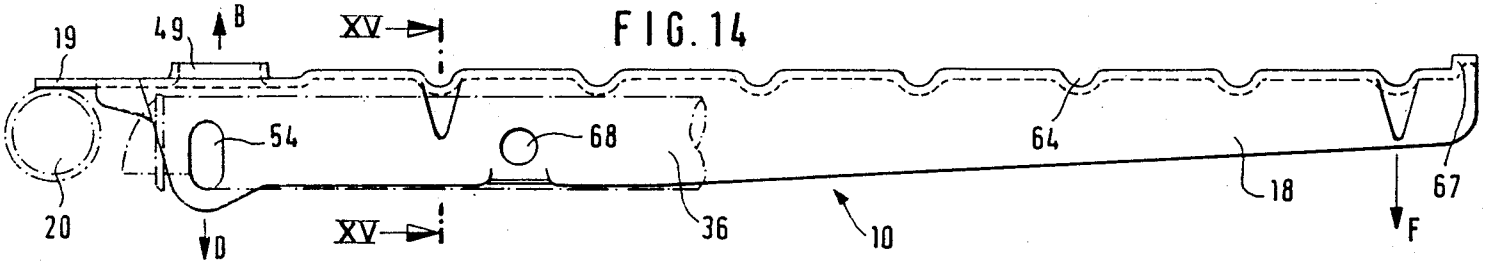
FIG. 14
FIG. 15
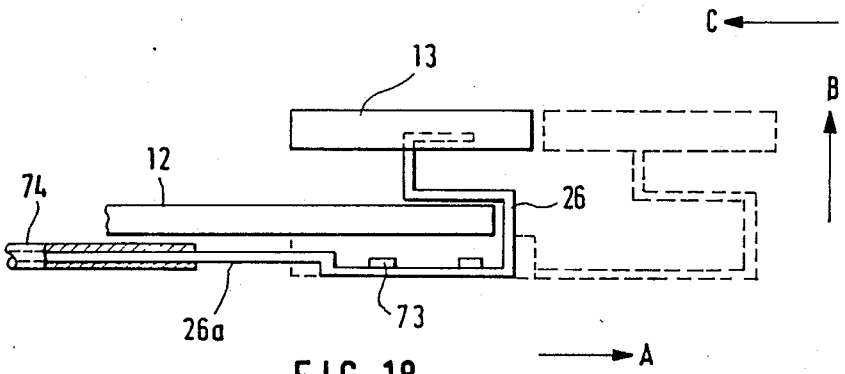
FIG. 18
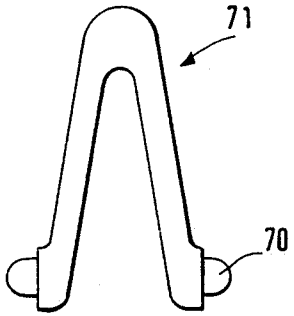
FIG. 17
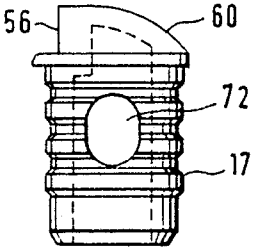
FIG. 16

IRONING BOARD HAVING FLIP-OUT ATTACHMENTS

BACKGROUND OF THE INVENTION

1. Field of the Invention

The invention relates to a flip-out ironing board with pedestal, sleeveboard, flatiron tray and laundry depository surface.

2. Description of the Related Art

Ironing boards are generally known. However, heretofore no board is known that adequately takes account of the ergonomic aspects.

Thus, ironing boards are on the market into which a few accessories are integrated, such as a flatiron tray, but which, because of their design, permit no other expansions, or these must be mounted additionally.

Consequently, the ironing board becomes either unwieldy, i.e., it can only be transported or stored with difficulty, or these parts must be attached each time prior to use or dismounted on completion of the ironing. This leads to the ergonomic drawbacks mentioned above, which can be overcome by a systematic arrangement of all the accessories to facilitate the work of the operator.

Another problem with known ironing boards is that, if the ironing board is set up on an uneven baseplate, such as a carpet or the like, there are no means for levelling the pedestal.

Also, no ironing boards are known wherein the pedestal is so constructed as to permit ironing in a sitting position.

The arrangement of the pedestal causes the operator's knee to bump against it. Further, in the prior art models it has been shown that the pedestal can flip out inadvertently during transport. This may cause property damage or even injuries.

There is no provision for retaining a squeeze bottle or the like, and thus it may turn over during ironing if no special depository surface is provided therefor.

SUMMARY OF THE INVENTION

Accordingly, the object of the invention is to provide an ironing board into which are integrated as compacted units all the necessary accessories, such as ironing tray, laundry depository surface, etc., that is to say, they are firmly mounted and, if necessary, disposed in such a way that they can be flipped in and out, and wherein all essential ergonomic aspects are given due consideration.

The above object is achieved according to the invention by providing the ironing board with hinges and giving it an ironing surface that can be flipped in and out.

In addition, the flip-out ironing board with pedestal, sleeveboard, flatiron tray and laundry depository surface is characterized by the fact that the pedestal consists of two asymmetrically constructed legs.

According to one embodiment, the flip-out ironing board is characterized by the fact that the legs of the pedestal can be extended in the manner of a telescope, whereby at the terminal end at least at one foot there is disposed a height-adjustable eccentric head knop that can function as a leveling device.

The flip-out ironing board with pedestal, sleeveboard, flatiron tray and laundry depository surface is further characterized by the fact that the laundry depository surface, which is provided with a squeeze bottle tray and a flip-out clothes rack, is placed at the same height as the ironing surface and can be swung thereto or away therefrom.

According to a particularly preferred embodiment, the flip-out ironing board is characterized by the fact that the clothes rack, which is hinged to the laundry depository, is provided with an articulation, which embraces the laundry depository frame and, for the purpose of locating a coat hanger, has a hinged bracket provided with a spring and an abutment cap as well as a lug at its end.

Another preferred embodiment is characterized by the fact that the squeeze bottle tray is disposed within the laundry depository and held at the frame and cross member of the laundry depository for the purpose of locating the squeeze bottle, and has a semicircular recess in the base.

The flip-out ironing board with pedestal, sleeveboard, flatiron tray and laundry depository surface is characterized by the fact that the sleeveboard is mounted such that it can be folded away and retracted.

Further, the flip-out ironing board with pedestal, sleeveboard, flatiron tray and laundry depository surface is characterized by the fact that a safety device provided for transport is disposed below the ironing surface.

BRIEF DESCRIPTION OF THE DRAWINGS

The invention will now be described with reference to the accompanying drawings which show a preferred embodiment, and in which:

FIGS. 9, 10 and 11 show a detail of the safety device for transport;

FIG. 12 is an enlargement of the pedestal;

FIG. 13 is a view of the pedestal from direction "F" shown in FIG. 12;

FIG. 14 is a side elevational view of a coat hanger according to the present invention;

FIG. 15 is a cross-sectional view taken along line XV—XV of FIG. 14;

FIG. 16 is a side elevational view of an abutment cap used in the coat hanger of FIG. 14;

FIG. 17 is a side elevational view of spring used in the coat hanger of FIG. 14;

FIG. 18 show the fold-away and swivel mechanism of the sleeveboard in a schematic diagram;

FIGS. 22 and 23 show a detail of the ironing surface that can be folded up.

DETAILED DESCRIPTION OF THE PREFERRED EMBODIMENTS

Figure 1:
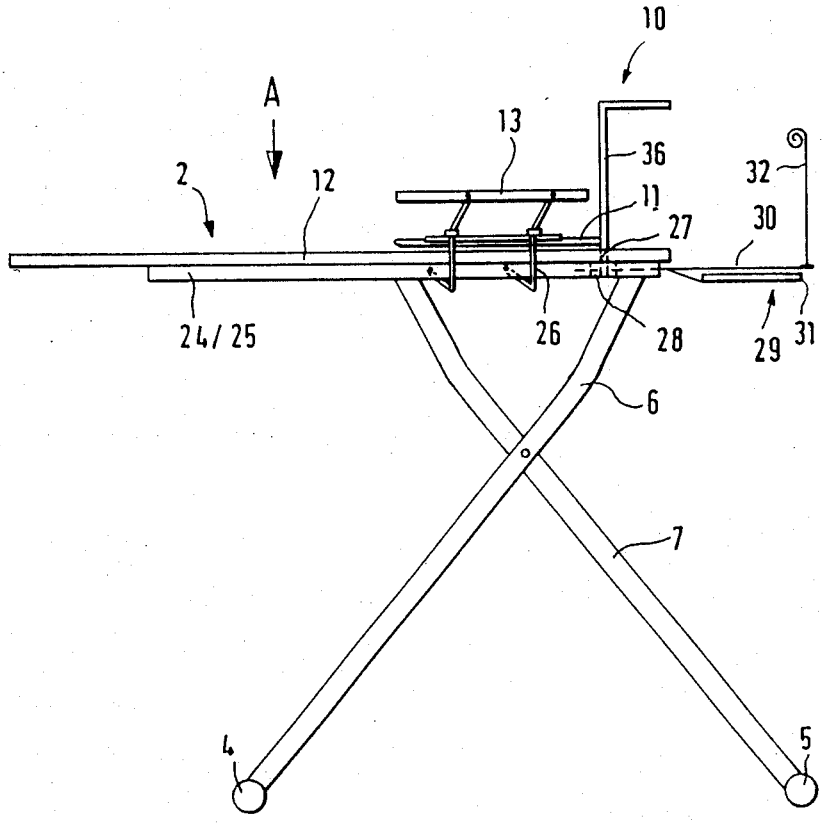
FIG. 1 is a front view of the ironing board.

The ironing board has a pedestal made up of two legs 6, 7 and an ironing board member 2 placed on two parallel guide rails 24 and 25.

By mounting on a wire strap 26 located on ironing board member, 2 a sleeveboard 13 is placed in such a way beneath the ironing surface 12 that it can be folded away and retracted.

At the back of the ironing board member 2 there is provided, at the same height as the ironing surface, a laundry depository 11 whose frame has a vertical offset 27. The vertical offset 27 is inserted into a holding bracket 28 disposed below the ironing board member 2 and can thus be swung to substantially coplanar with the ironing surface 12, so that in the swung-in position the depository surface 11 is located directly above the ironing surface 12, i.e., there is only a small clearance between both surfaces. At the frame of the laundry depository surface 11 there is mounted a clothes rack 10 which permits the hanging of coat hangers. The shape of the clothes rack will be discussed in detail with reference to FIGS. 14–17.

Preferably, the flatiron tray 29 consists of a braided wire 30 attached to the guide rails 24 and 25 and having an inner depository surface 31.

A whip spring 32 is provided at the braided wire 30 for the cables of an iron.

Figure 2:
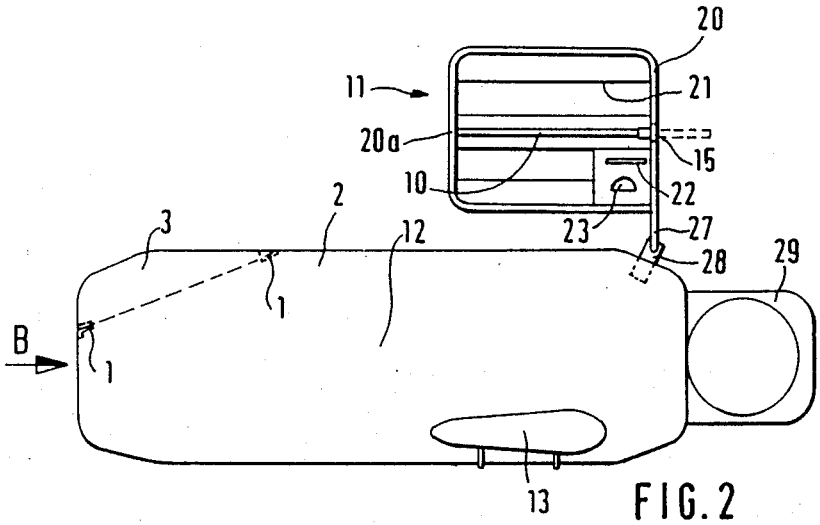
FIG. 2 is a top plan view of the ironing board from direction "A" indicated in FIG. 1.

FIG. 2 is a top plan view of the ironing board from direction "A" shown in FIG. 1.

The shaping of the ironing board 2 will now be discussed in addition to the arrangements of the accessories, such as sleeveboard 13, laundry depository surface 11, clothes rack 10 and ironing board tray 29. Here, the arrangement of the fold-away seat 3, which is provided with hinges 1 is of great importance. Thus, the ironing surface 12 can, if necessary, be narrowed down to facilitate certain ironing procedures.

The laundry depository surface 11 consists of cross members 21 and a frame 20, whose end is passed into an offset 27 disposed below the ironing surface and is pivoted therein. It can be seen that the clothes rack 10 with its articulation 15 embraces the frame 20 of the laundry depository 11 and is thus pivoted on the frame 20.

Figure 3:
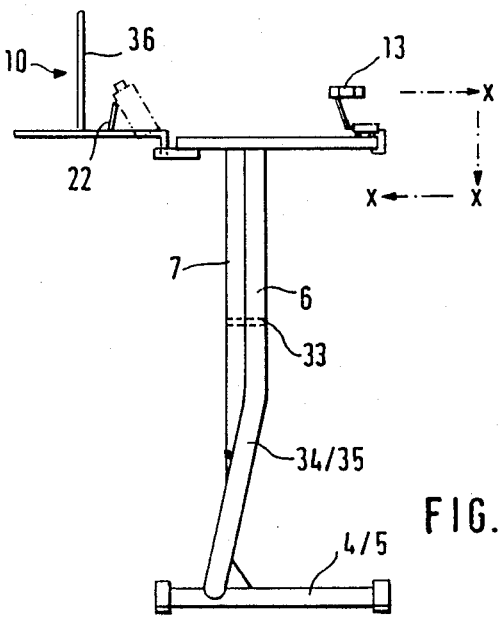
FIG. 3 is a view of the ironing board from direction "B" shown in FIG. 1.

In the swung-in state, the clothes rack 10 rests on the frame 20*a*. The laundry depository has a semicircular recess 23 in which the squeeze bottle 9 is received so as to tilt at an inclined position and rest against wire strap 22 (FIG. 3). The recess 23 is included in a squeeze bottle tray position which is part of the laundry tray. On account of this arrangement, the squeeze bottle will not leave its position even during vigorous ironing motions and can at any time be seized with a simple hand motion.

FIG. 3 is a view of the ironing board from direction "B" shown in FIG. 2. In this perspective view, the fold-away mechanism of the sleeveboard 13 is denoted with the dot-dashed directional arrow "x". The fold-away-and-swivel mechanism will be explained in detail with reference to FIG. 18. The pedestal has a common pin 33 about which pivot the two legs 6 and 7 of the pedestal.

In the lower region, the legs have a deflection 34, 35 each of which changes into a horizontal foot 4, 5. The function of the horizontal feet will be discussed in detail with reference to FIGS. 12 and 13.

Figure 4:
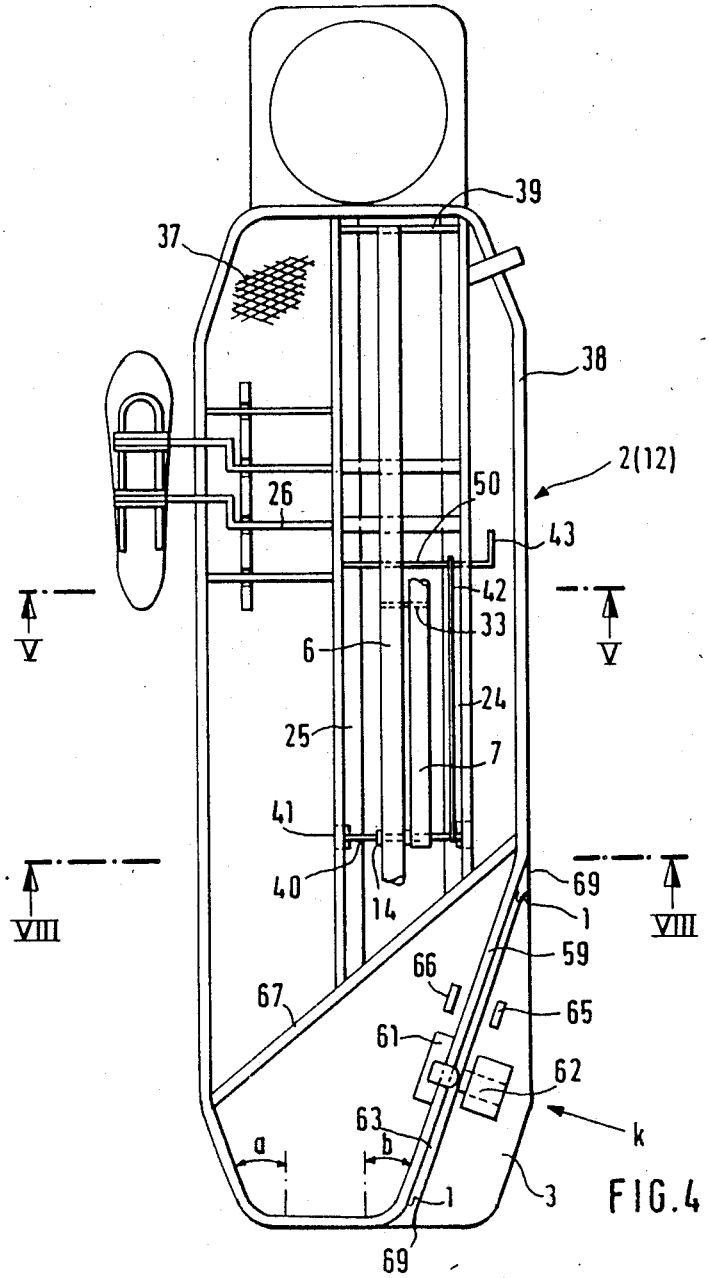
FIG. 4 is a view of the ironing board from the bottom.

FIG. 4 is a bottom view of the ironing board. The ironing board member 2 consists of a braided wire sheet 37 which rests on a square pipe frame 38. Two angular guide rails 24 and 25 rest on the braided wire sheet 37.

The square pipe frame 38 has substantially the shape of the ironing surface 12. A distinguishing feature of the frame 38 is the fact that the chamfer 59 has two corner seatings 69 that locate the hinges 1.

Parallel to the chamfer 59, an abutment means 61 is disposed beneath the ironing surface. When the locking tongue 62 is moved toward "k", locking occurs and the small ironing surface 3 can no longer be swung away. The swivel or fold-away motion is made possible by placing below the ironing surface 12 a tube 63 with pins, which are guided in the corner seatings 69. This mechanism forms the hinge.

In this embodiment, a magnet 65 is located beneath the ironing surface in order to hold the small ironing surface 3. This magnet 65 adheres to the braided wire sheet.

However, this mount can also be undone by a grid or similar device. The thwart tubular bar 67 locates guide rails 24 and 25. It is worth noticing that on account of the constructional nature of the tubular frame and of the fold-away ironing surface, the angles of slip a and b of the swung-in ironing surface are congruent.

Figure 22:
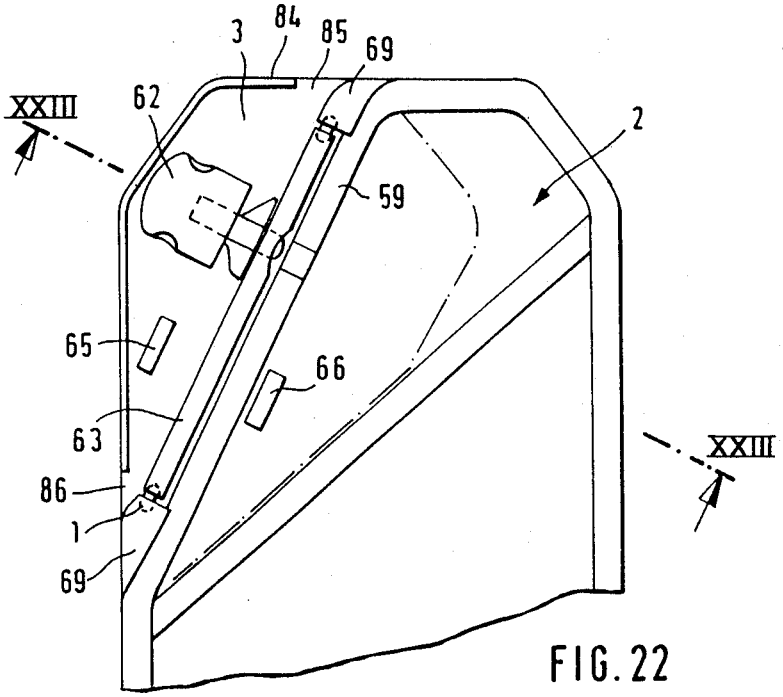
FIG. 22 is a detailed bottom view of a fold-up portion of the ironing board according to the present invention.
Figure 23:
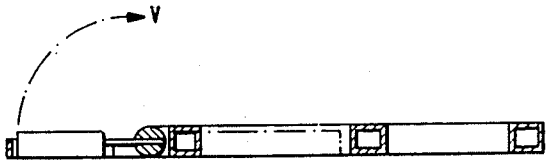
FIG. 23 is a cross-sectional view taken along line XXIII—XXIII of FIG. 22.

In the swung-in state, the ironing surface 3 is retracted completely below the ironing board. The nature of the fold-away surface is again discussed in FIGS. 22 and 23.

Three pins 33, 39 and 40 are also shown in the drawings. Pin 33 is the common pin about which the legs 6 and 7 are pivoted. The pin 39 is stationary between the guide rails 24 and 25, to which the leg 6 is attached.

The pin 40 is provided with sliding ends 41 and can be moved alongside within guide rails 24 and 25, with leg 7 being attached to said pin.

This results in a shearing action of the pedestal.

A bar 42 attached to pin 40 is moved parallel to guide rails 24 and 25. A sliding of the pedestal is made possible by actuating the grip lever 43. Tip 44 (FIGS. 5–8) of bar 42 is guided in a recess 45 (FIGS. 5–8) of a piece of angle sheet iron.

Figure 24:
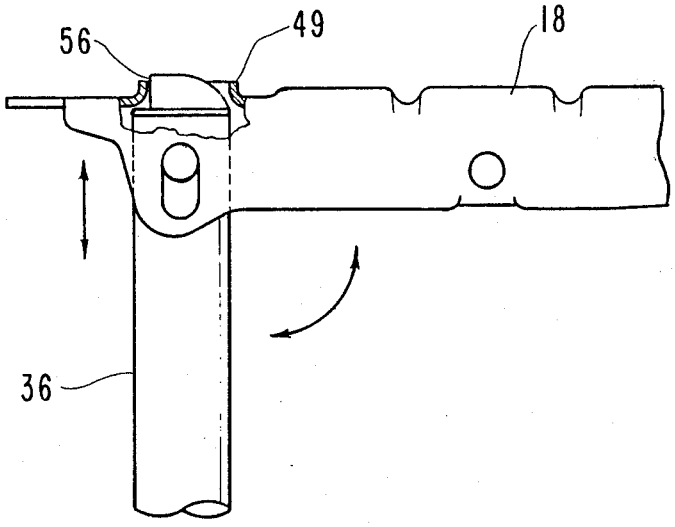
FIGS. 24 and 25 illustrate the two different pivot axes for the support 36 and bracket 18.
Figure 25:
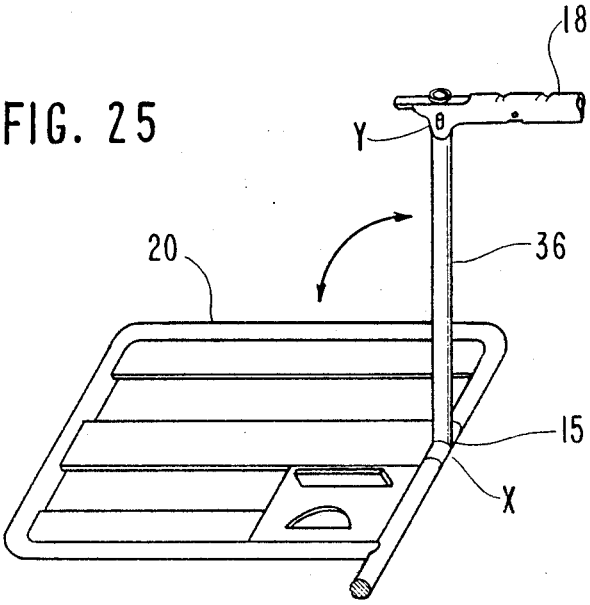

There is disposed at 40 the safety device 14 for transport, into which leg 6 is pressed and is held by lugs FIGS. 24 and 25 illustrate the two different pivot axes for the support 36 and bracket 18 53 (FIGS. 9–11). Wire straps 26 of the sleeveboard are discussed with reference to FIG. 18, as mentioned earlier.

Figure 5:
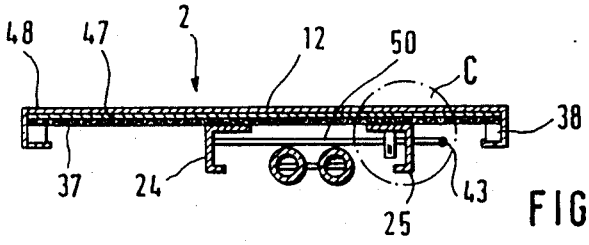
FIG. 5 is a cross-sectional view taken along the line V—V shown in FIG. 4.

FIG. 5 is a cross-sectional view of the ironing board taken along the line V—V of FIG. 4.

Ironing board member 2 has a braided wire sheet 37 which rests on a square pipe frame 38. Ironing surface 12 is provided with a felt lining 47 and slip-on cover 48.

Grip lever 43 changes into a fulcrum 50 which is mounted in guide rails 24 and 25.

Fulcrum 50 is surrounded by angle iron piece 46 which is preloaded by a spring 51 (FIG. 6), into whose recess 45 bar 42 is guided.

Figure 6:
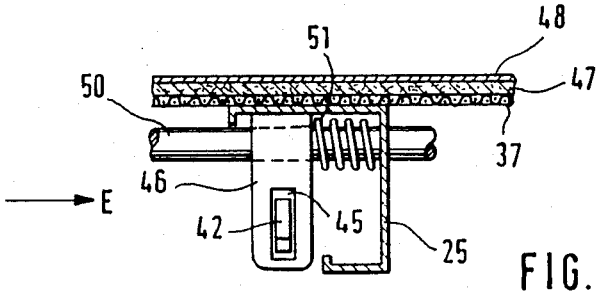
FIG. 6 is a detail of "C" shown in FIG. 5.

FIG. 6 shows a detail of "C" as shown in FIG. 5 and depicts guide rail 25 with fulcrum 50 which is surrounded by angle iron piece 46. A spring 51 preloads angle sheet iron and the angle sheet iron 46 guides bar 42 in its recess 45.

Figure 7:
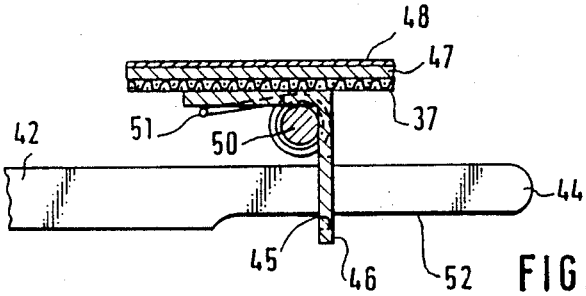
FIG. 7 is a view of the detail from direction "E" shown in FIG. 6.

FIG. 7 is a view of the detail of FIG. 6 from direction "E". It can be seen that bar 42 has a taper 52, which moves freely within recess 45, even if grip lever 43 is not actuated.

Therefore, in order to prevent the pedestal from flipping out inadvertently, the safety device for transport depicted in FIG. 4 is placed on pin 40.

Figure 8:
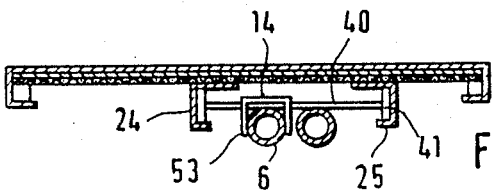
FIG. 8 is a cross-sectional view of the ironing board taken along the line VIII—VIII shown in FIG. 4.

FIG. 8 is a cross-sectional view of the ironing board taken along the line V—V of FIG. 4. Here, pin 40 can be seen with the safety device for transport, whose lugs 53 clamp leg 6 into position. Sliding ends 41 enable pin 40 to travel between guide rails 24 and 25 in a longitudinal direction.

FIGS. 9, 10 and 11 show in various views the safety device for transport, which essentially comprises a base 57 and two retaining lugs 53. Base 57 has a semicircular recess 58 provided for locating the pin 40. Made integral with base 57 are the two elastic lugs 53 which, when leg 6 is pressed on, deflect to such a degree that lugs 53 embrace leg 6 and clamp the same into position.

FIG. 12 is a schematic diagram showing the geometry of pedestal legs 6 and 7. The horizontal foot 4/5 is telescopic and can be pulled out in direction "Y" so as to ensure improved stability. For steadiness, a corner piece of frame 55 is interposed between pedestal legs 6 and 7 and feet 4 and 5.

FIG. 13 is a schematic view of foot 5 from the direction "F" shown in FIG. 12. Roller 8 placed at the horizontal foot 5 is mounted eccentrically at foot 5, so that small irregularities of the floor can be compensated by turning the roller 8. Here, the eccentricity can be achieved selectively by the shape of the roller or of the foot.

FIGS. 14–17, 24, and 25 show the clothes rack 10. It embraces with its hinge 15 frame 20 (FIG. 2) of laundry depository 11 and is thus pivotally connected thereto so that the support linkage 36 is pivotal between horizontal and vertical positions. The vertical support linkage 36 has a length such that it rests in the swung-in state (horizontal position) on frame 20*a* of laundry depository or tray 11 through a rearward extension 19 of the bracket 18.

Hinged bracket 18 has on both sides a slot 54 through which is passed a spring or rivet and movably attaches hinged bracket 18 to support linkage 36 and to abutment cap 17 (FIG. 16). Abutment cap 17 is inserted into the end of linkage 36 and formed such that after pushing up bracket 18 toward "b", the bracket 18 then pivoted on its rounded joint 60. After pressing bracket 18 downwardly toward "d" when bracket 18 is substantially perpendicular to the support linkage 36, the bracket abuts with its shoulder 49 edge 56 and prevents collapsing, even when loaded with articles of clothing, i.e., when a force "F" is present. Bracket 18 has several notches 64 for suspending coat hangers and the latter are prevented by pushed-up lug 67 from falling off forwardly.

When bracket 18 is being swung in, bores 68 on both sides engage lugs 70 of spring 71 disposed in support linkage 36.

The semicircular shape of bracket 18, as shown in FIG. 15, assures complete surrounding of support linkage 36 by bracket 18, so that both parts appear as one element in the swung-in state.

FIG. 16 shows abutment cap 17 in detail, in which rounded joint 60 and abutment means 56 are illustrated. Slot 72 locates the common splint or rivet.

Abutment cap 17 lies inside support linkage 36 after assembly.

FIG. 17 shows spring 71 in detail. Preferably, it is V-shaped and has at its ends two lugs 70, which project through the wall of support linkage 36 and engage in their bores 68 when bracket 18 is being swung into position.

FIG. 18 shows the principle of the flap-hinging and swinging mechanism sleeveboard 13.

Here, two wire straps 26 disposed parallel to two distance spacers 73 are matched to two fulcrums 26*a* beneath sleeveboard 13.

Wire straps 26 are so deflected that storage below and, for ironing, above the ironing surface 12 is possible. By pulling sleeveboard toward "A", the latter is pulled ahead below the board. By rotating the fulcrums 26*a* within tubes 74, the sleeve board 13 moves upwardly toward "B", the height of the sleeveboard is altered and it is positioned over ironing surface 12 when being pushed in toward "C".

The wire straps are retracted when being pushed into tubes 74 disposed below the ironing surface.

Figure 19:
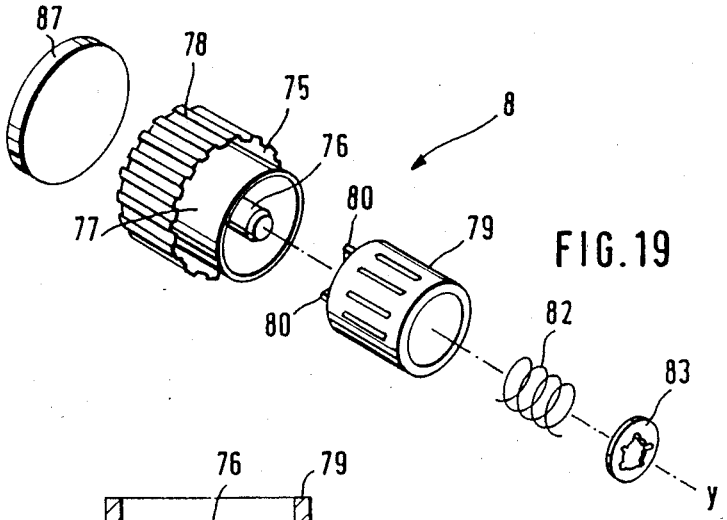
FIG. 19 is an exploded view of a roller according to the present invention.
Figure 20:
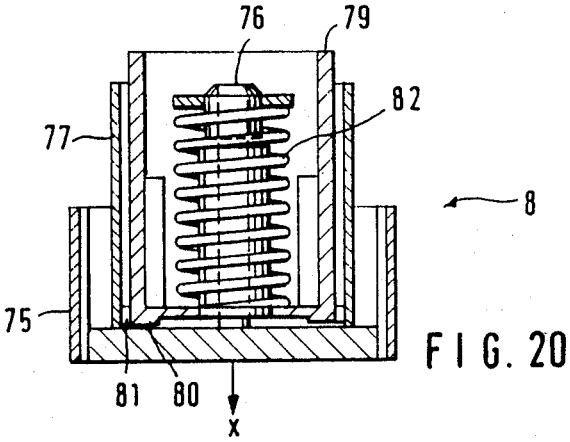
FIG. 20 is a cross-sectional view of the roller of FIG. 19.
Figure 21:
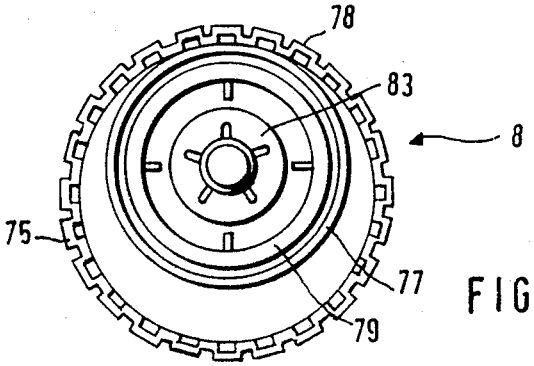
FIG. 21 is a top plan view of the roller of FIG. 19.

FIGS. 19–21 show the details of the eccentric rollers 8. Each eccentric roller 8 consists of a body 75 with eccentrically disposed pin, from which extends an integral cylinder 76 surrounded by a circular tube 77. Body 75 is provided with grooved elevations 78 for stability. A facing cap 87 is disposed on the end surface. An inner cylinder 79 is inserted into circular tube 77 and locks by its lugs 80 inner cylinder 79 to prevent it from rotating, because lugs 80 engage in grid 81 located in circular tube 77. Not until body 78 is pulled at roller 8 toward "x"—during which spring 82 surrounding cylinder 76 is compressed—can body 78 be rotated. Here, a safety disc 83 is disposed at the end of the cylinder. Level equalization is possible on account of the eccentric arrangement of the pin.

FIGS. 22 and 23 again show the flap-hinge surface of the ironing board (FIG. 22) and a cross-section taken along the line XXIII—XXIII (FIG. 23). A distinguishing feature of the invention is the fact that upset wall 84 of flap-hinge surface 3 has a recess 85/86. When flap-hinge surface 3 is moved toward "v", it will be enabled to retract completely within ironing board 2 (dot-dash line) and not to stand out. This is essentially made possible by the arrangement of the hinges, which consist of a pin (1) disposed within tube 63 and corner seating 69. It assures rotation toward "v".

It follows from the invention that this ironing board solves almost all of the ergonomics problems.

The arrangement of all accessories, such as flatiron tray with cables, swivel laundry depository with coat hanger and squeeze bottle tray, fold-away sleeveboard, fold-away ironing surface, arrangement of the safety device for transport and the shape of the pedestal, all of which make ironing in the sitting position possible since the legs are deflected in the knee area, as well as the telescopic-type adjustment of length and height of the vertical feet meet all of the requirements of an ironing board that has been perfected from the ergonomics standpoint.

I claim:

1. An ironing board apparatus comprising an ironing board member having a substantially elongated rectangular shape, an upper, ironing surface and an opposite lower surface, two opposite ends and two opposite longitudinal sides, the ironing board member having a main portion and a foldaway corner portion pivotally connected to the main portion by a hinge and being foldable about an axis which extends diagonally between one of the ends and one of the sides of the ironing board member between a deployed position in which the corner portion is coplanar with the main portion and a folded position in which the corner portion is disposed beneath the main portion;

a pedestal connected to the lower surface of the ironing board member;

a retractable sleeveboard connected to the ironing board member for movement over and under one of the two longitudinal sides thereof;

a flat iron tray connected to the end of the ironing board member opposite the foldaway corner portion; and a laundry tray pivotally connected to the ironing board member for movement over the longitudinal side opposite the sleeveboard, wherein the pedestal comprises two pivotally connected legs, each having a horizontal foot, wherein at least one horizontal foot has leveling means provided at each end of the foot, and wherein the leveling means is an eccentrically mounted roller.

2. An ironing board apparatus according to claim 1, wherein at least one horizontal foot is telescopic in the horizontal direction.

3. An ironing board apparatus according to claim 1, wherein the laundry tray includes a squeeze-bottle tray portion which is movable along with the laundry tray into a coplanar position with the upper surface of the ironing board member.

4. An ironing board apparatus according to claim 3, further comprising a fold-away clothes rack hinged to a frame of the laundry tray.

5. An ironing board apparatus according to claim 4, wherein the clothes rack includes an articulation which embraces the laundry tray frame and has a hinged bracket provided with a spring and an abutment cap, said hinged bracket having a lug at one end thereof.

6. An ironing board apparatus according to claim 3, wherein the squeeze-bottle tray includes a semicircular recess and a wire strap for supporting a squeeze bottle in a standing tilted disposition.

7. An ironing board apparatus according to claim 1, further comprising safety means disposed on the lower surface of the ironing board member for holding the pedestal in a transport position.

8. An ironing board apparatus comprising:

an ironing board member having a substantially elongated rectangular shape, an upper, ironing surface and an opposite lower surface, two opposite ends and two opposite longitudinal sides;

a pedestal connected to the lower surface of the ironing board member; and a laundry tray having a squeeze-bottle tray portion, the laundry tray being pivotally connected to the ironing board member for movement over one of the longitudinal sides thereof between a deployed position in which the laundry tray is substantially coplanar with the upper surface of the ironing board member, and a retracted position in which the laundry tray is disposed over the ironing board member; and a clothes rack hinged to the laundry tray and including an articulation which embraces a frame of the laundry tray, and a hinged bracket having a spring and an abutment cap, said hinged bracket having a lug at one end thereof.

9. An ironing board apparatus comprising:

an ironing board member having a substantially elongated rectangular shape, an upper, ironing surface and an opposite lower surface, two opposite ends and two opposite longitudinal sides;

a pedestal connected to the lower surface of the ironing board member; and a laundry tray having a squeeze-bottle tray portion, the laundry tray being pivotally connected to the ironing board member for movement over one of the longitudinal sides thereof between a deployed position in which the laundry tray is substantially coplanar with the upper surface of the ironing board member, and a retracted position in which the laundry tray is disposed over the ironing board member;

said squeeze-bottle spray including a semi-circular recess and a wire strap for supporting a squeeze-bottle in an upright tilted position.

10. An ironing board apparatus comprising:

an ironing board member having a substantially elongated rectangular shape, an upper, ironing surface and an opposite lower surface, two opposite ends and two opposite longitudinal sides, the ironing board member having a main portion and a foldaway corner portion pivotally connected to the main portion by a hinge and being foldable about an axis which extends diagonally between one of the ends and one of the sides of the ironing board member between a deployed position in which the corner portion is coplanar with the main portion and a folded position in which the corner portion is disposed beneath the main portion;

a pedestal comprises two pivotally connected legs, each having a horizontal foot wherein at least one horizontal foot is telescopic in the horizontal direction wherein at least one horizontal foot has leveling means disposed on at least one end of the foot, and wherein the leveling means is an eccentrically mounted roller; and a retractable sleeveboard connected to the ironing board member being supported for movement over and under one of the two longitudinal sides thereof.

11. An ironing board apparatus according to claim 10, further comprising a flat iron tray connected to the end of the ironing board member opposite the foldaway corner portion.

12. An ironing board apparatus according to claim 11, further comprising a laundry tray pivotally connected to the ironing board member for movement over the longitudinal side opposite the sleeveboard.

13. An ironing board apparatus according to claim 10, wherein the laundry tray includes a squeeze-bottle tray portion which is movable along with the laundry tray into a coplanar position with the upper surface of the ironing board member.

14. An ironing board apparatus according to claim 13, further comprising a fold-away clothes rack hinged to a frame of the laundry tray.

15. An ironing board apparatus according to claim 14, wherein the clothes rack includes an articulation which embraces the laundry tray frame and has a hinged bracket provided with a spring and an abutment cap, said hinged bracket having a lug at one end thereof.

16. An ironing board apparatus according to claim 13, wherein the squeeze-bottle tray includes a semicircular recess and a wire strap for supporting a squeeze bottle in a standing tilted disposition.

17. An ironing board apparatus according to claim 10, further comprising safety means disposed on the lower surface of the ironing board member for holding the pedestal in a transport position.

* * * * *